US012594457B2

(12) United States Patent
Sung et al.

(10) Patent No.: US 12,594,457 B2
(45) Date of Patent: Apr. 7, 2026

(54) MOUTH EXERCISING DEVICE

(71) Applicant: Kreuznach LLC, Greenwich, CT (US)

(72) Inventors: Susannah Sung, Greenwich, CT (US); Mohan Rajasekaran, Bristol, CT (US)

(73) Assignee: KREUZNACH LLC, Greenwich, CT (US)

( * ) Notice: Subject to any disclaimer, the term of this patent is extended or adjusted under 35 U.S.C. 154(b) by 66 days.

(21) Appl. No.: 18/753,555

(22) Filed: Jun. 25, 2024

(65) Prior Publication Data

US 2025/0387666 A1 Dec. 25, 2025

(51) Int. Cl.
*A63B 23/03* (2006.01)

(52) U.S. Cl.
CPC ..... *A63B 23/032* (2013.01)

(58) Field of Classification Search
CPC ..... A63B 23/032
See application file for complete search history.

(56) References Cited

U.S. PATENT DOCUMENTS 1,714,029 A * 5/1929 Kuhn ..... A63B 23/032 482/11
4,944,313 A * 7/1990 Katz ..... A61B 1/00154 128/207.14
5,174,284 A * 12/1992 Jackson ..... A61M 16/0493 128/200.26
6,203,471 B1 * 3/2001 Akihiro ..... A63B 23/032 128/859
6,524,262 B1 * 2/2003 Akihiro ..... A63B 23/032 482/11
8,376,912 B1 * 2/2013 Dedvukaj ..... A63B 21/028 482/148
9,956,111 B2 * 5/2018 Togliatti ..... A61F 5/566
10,617,910 B1 * 4/2020 Harris ..... A63B 21/023
11,167,169 B1 * 11/2021 Harris ..... A63B 23/032
2012/0283069 A1 * 11/2012 Martin ..... A63B 23/032 482/11
2013/0260963 A1 * 10/2013 Takashi ..... A63B 23/032 482/11
2015/0133269 A1 * 5/2015 Landis ..... A63B 23/032 29/428

* cited by examiner

*Primary Examiner* — Joshua T Kennedy
(74) *Attorney, Agent, or Firm* — CANTOR COLBURN LLP

(57) ABSTRACT

A mouth exercising device defines a first direction and a second direction along a first axis, a third direction and a fourth direction along a second axis orthogonal to the first axis, and a fifth direction and a sixth direction along a third axis orthogonal to the first axis and the second axis, and includes an outer body having a first body and a second body arranged along the second direction, and an inner body extending between a first surface of the first body that faces the fourth direction and a first surface of the second body that faces the third direction.

19 Claims, 6 Drawing Sheets

MOUTH EXERCISING DEVICE

BACKGROUND

The present disclosure relates to a mouth exercising device.

A device for effective exercise of muscles in and around the mouth is desirable.

SUMMARY

In accordance with a non-limiting example, a mouth exercising device defines a first direction and a second direction along a first axis, a third direction and a fourth direction along a second axis orthogonal to the first axis, and a fifth direction and a sixth direction along a third axis orthogonal to the first axis and the second axis, and comprises an outer body comprising a first body and a second body arranged along the second direction, and an inner body extending between a first surface of the first body that faces the fourth direction and a first surface of the second body that faces the third direction.

In addition to one or more of the features described herein, the outer body comprises a bridge portion extending between the first body and the second body along the second axis.

In addition to one or more of the features described herein, the outer body is formed of a material having a first modulus of elasticity, the inner body is formed of a material having a second modulus of elasticity, and the second modulus of elasticity is lower than the first modulus of elasticity.

In addition to one or more of the features described herein, the inner body and the outer body are formed of food-grade silicone.

In addition to one or more of the features described herein, the first body comprises a first positioning structure on a second surface of the first body that faces the third direction.

In addition to one or more of the features described herein, the first positioning structure comprises a first recess that is curved.

In addition to one or more of the features described herein, a drain is formed at an end of the first recess in the fifth or sixth direction.

In addition to one or more of the features described herein, the upper positioning structure comprises a second recess disposed in the second direction of the first recess.

In addition to one or more of the features described herein, a drain is formed an end of the second recess in the second direction.

In addition to one or more of the features described herein, the second body comprises a second positioning structure on a second surface thereof that faces the fourth direction.

In addition to one or more of the features described herein, the second positioning structure comprises a curved recess.

In addition to one or more of the features described herein, the inner body comprises a ring-shaped structure having a through-hole formed therein.

In addition to one or more of the features described herein, the outer body comprises a bridge portion extending between the first body and the second body along the second axis, and a gap is formed between the bridge portion and the inner body.

In addition to one or more of the features described herein, the first body comprises a pair of first shoulder portions that extend farther in the third direction than a remainder of the first body.

In addition to one or more of the features described herein, the first body comprises a first central portion extending continuously between the first shoulder portions, the first shoulder portions extending farther in the third direction than the central portion.

In addition to one or more of the features described herein, the second body comprises a pair of second shoulder portions that extend farther in the fourth direction than a remainder of the second body.

In addition to one or more of the features described herein, the second body comprises a second central portion extending continuously between the second shoulder portions, the second shoulder portions extending farther in the fourth direction than the central portion.

In addition to one or more of the features described herein, the mouth exercising device has a first configuration that is an uncompressed state and a second configuration that is a compressed state, in the first configuration, a first outer surface of the inner body in the fifth direction and a second outer surface of the inner body in the sixth direction do not contact the first surface of the first body or the first surface of the second body, and, in the second configuration, at least a portion of the first outer surface of the inner body contacts the first surface of the first body and the first surface of the second body, and at least a portion of the second outer surface of the inner body contacts the first surface of the first body and the first surface of the second body.

In accordance with a non-limiting example, the inner body has a length along the first axis that is 50% to 60% of a total length of the mouth exercising device along the first axis.

In accordance with a non-limiting example, the inner body and the outer body are integrally formed.

The above features and advantages, and other features and advantages of the disclosure are readily apparent from the following detailed description when taken in connection with the accompanying drawings.

DETAILED DESCRIPTION

Figure 1:
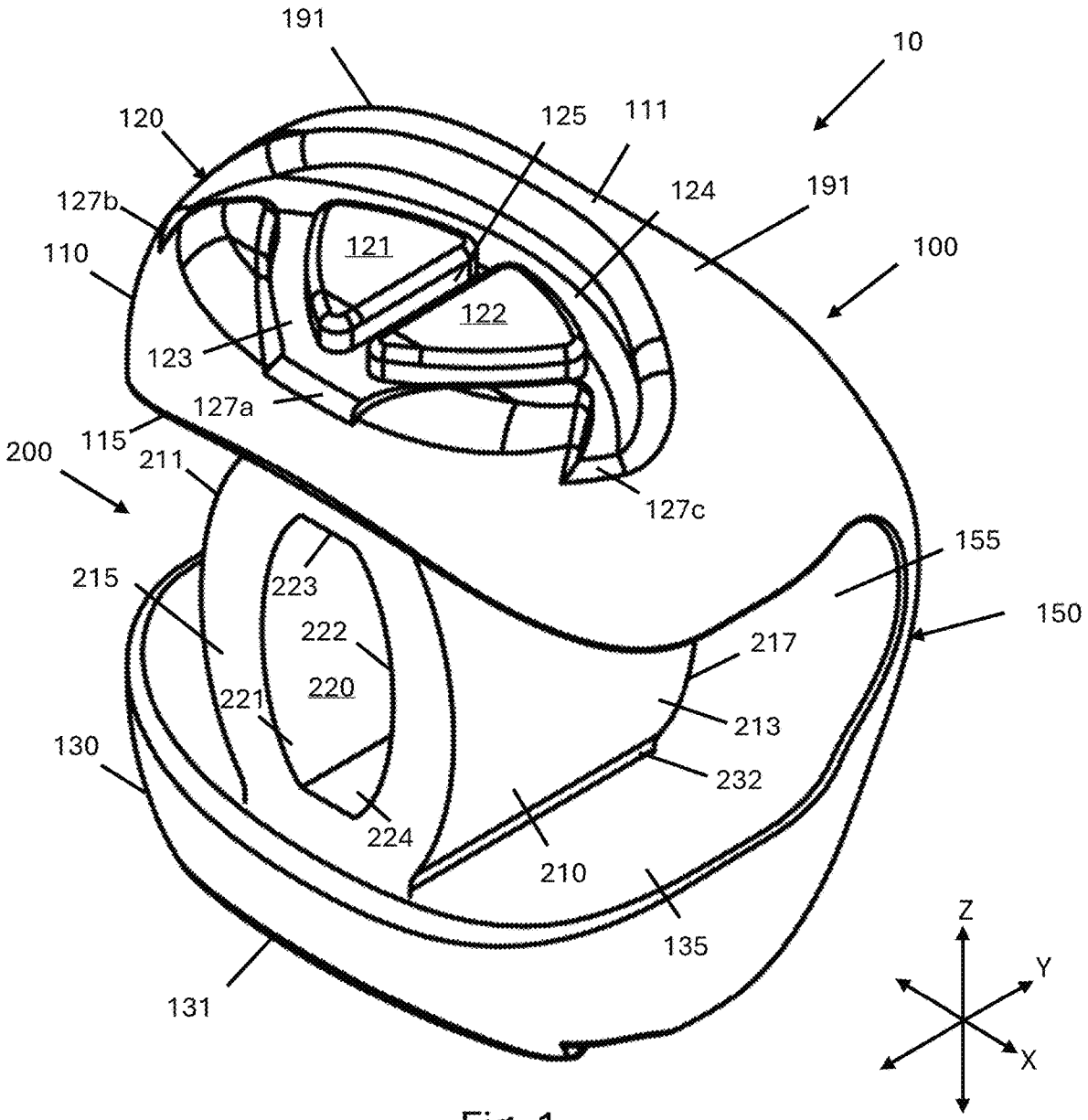
FIG. 1 shows a rear top perspective view of a mouth exercising device in a first configuration according to one or more embodiments.
Figure 2:
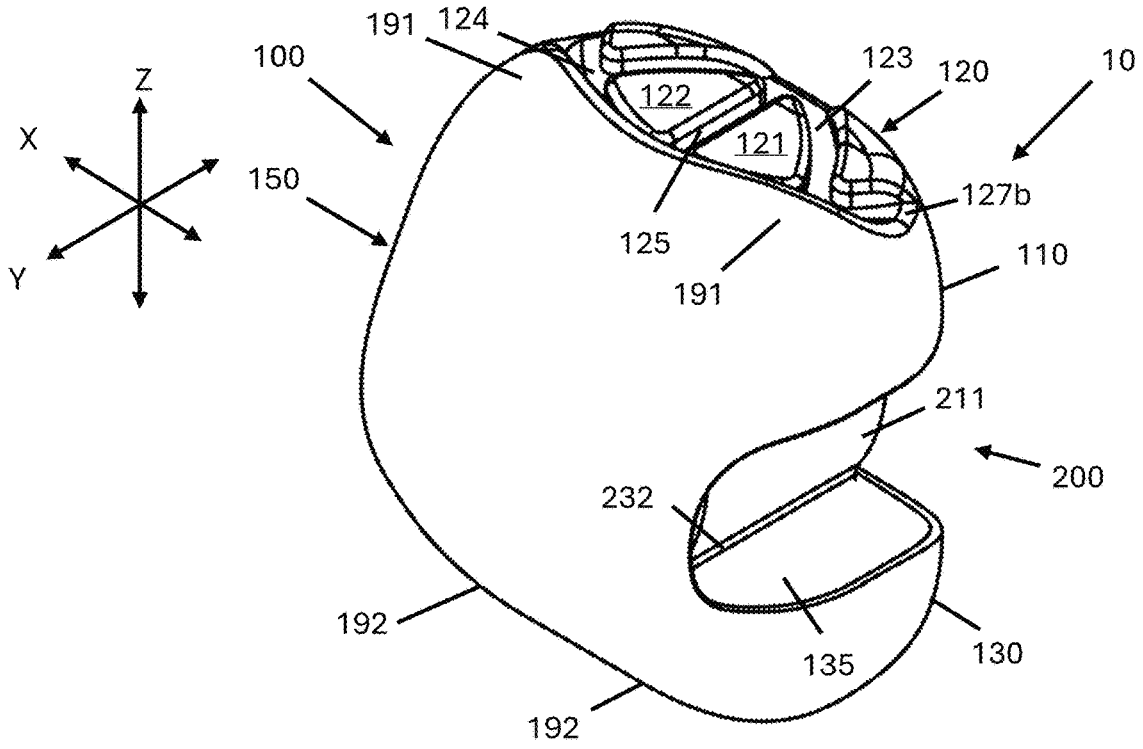
FIG. 2 shows a front top perspective view of the mouth exercising device shown in FIG. 1.
Figure 3:
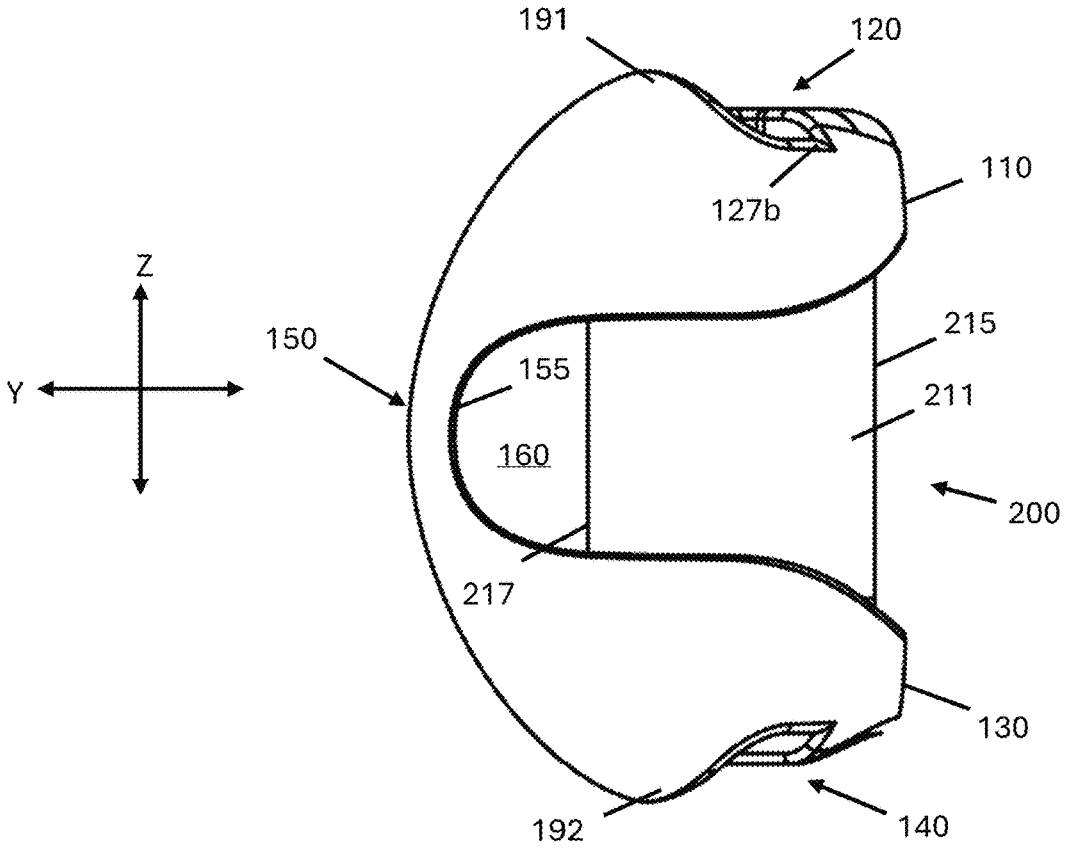
FIG. 3 shows a side view of the mouth exercising device shown in FIG. 1.

The following description is merely exemplary in nature and is not intended to limit the present disclosure, its application or uses. It should be understood that throughout the drawings, corresponding reference numerals indicate like or corresponding parts and features.

A mouth exercising device 10 according to a non-limiting example is shown in FIGS. 1-6. In FIGS. 1-6, the mouth exercising device 10 is in a first configuration. The mouth exercising device 10 may define a forward direction and a rearward direction along a-Y axis, an upper direction and a lower direction along a Z-axis, and a rightward direction and a leftward direction along an X-axis. The forward, rearward, upper, lower, rightward, and leftward directions are defined with respect to a user of the mouth exercising device 10.

The mouth exercising device 10 may include an outer body 100 and an inner body 200 within the outer body 100. The outer body 100 and the inner body 200 may be integrally formed. For example, the outer body 100 and the inner body 200 may be co-molded. According to one or more embodiments, the outer body 100 and/or the inner body 200 may be made of food-grade silicone, although the present disclosure is not limited thereto. For example, the outer body 100 and/or the inner body 200 may be formed of plastics, resins, elastomers, rubbers, or other materials known in the art as appropriate. According to one or more embodiments, the outer body 100 and the inner body 200 may be formed of materials having different elasticity. As a non-limiting example, the outer body 100 may be formed of food-grade silicone having a first modulus of elasticity, and the inner body 200 may be formed of food-grade silicone having a second modulus of elasticity. The second modulus of elasticity may be lower than the first modulus of elasticity. Alternatively, the outer body 100 and the inner body 200 may be formed of the same material.

The outer body 100 may include an upper body 110, a lower body 130, and a bridge portion 150 extending between the upper body 110 and the lower body 130. The upper body 110 may have a convexly contoured upper surface 111 and a concavely contoured lower surface 115. The lower body 130 may have a convexly contoured lower surface 131 and a concavely contoured upper surface 135.

An upper positioning structure 120 may be formed on the upper surface 111 of the upper body 110. The upper positioning structure 120 may include a front recess 124 and a rear recess 123 that are continuous with each other. At least a portion of a forward end of the front recess 124 may be curved to correspond to a shape of the upper teeth of the user. The upper positioning structure 120 may further include a first plateau 121 and a second plateau 122, with a channel 125 therebetween. The first plateau 121 and the second plateau 122 may have flat upper surfaces and may be substantially triangular, although the first plateau 121 and the second plateau 122 are not limited thereto. The first plateau 121 and the second plateau may have curved surfaces facing the forward direction that correspond to the shape of the upper teeth of the user. The first plateau 121 may include a curved surface facing the leftward and rearward direction, and/or a straight surface facing the rightward direction. The second plateau 121 may include a curved surface facing the rightward and rearward direction, and/or a straight surface facing the leftward direction. The channel 125 may extend from the front recess 124 to the rear recess 123. The upper positioning structure 120 may further include a first drain 127*a* posited at a rear end of the rear recess 123, a second drain 127*b* positioned at a left rear end of the front recess 124, and a third drain 127*c* positioned at a right rear end of the front recess 124.

A lower positioning structure 140 may be formed on the lower surface 131 of the lower body 130. The lower positioning structure 140 may include a third plateau 143 and a curved recess 144 at a position in the forward direction of the third plateau 143. The curved recess 144 may be curved to correspond to the lower teeth of the user. The third plateau 143 may be substantially oval and may have a convex surface facing the lower direction.

Figure 4:
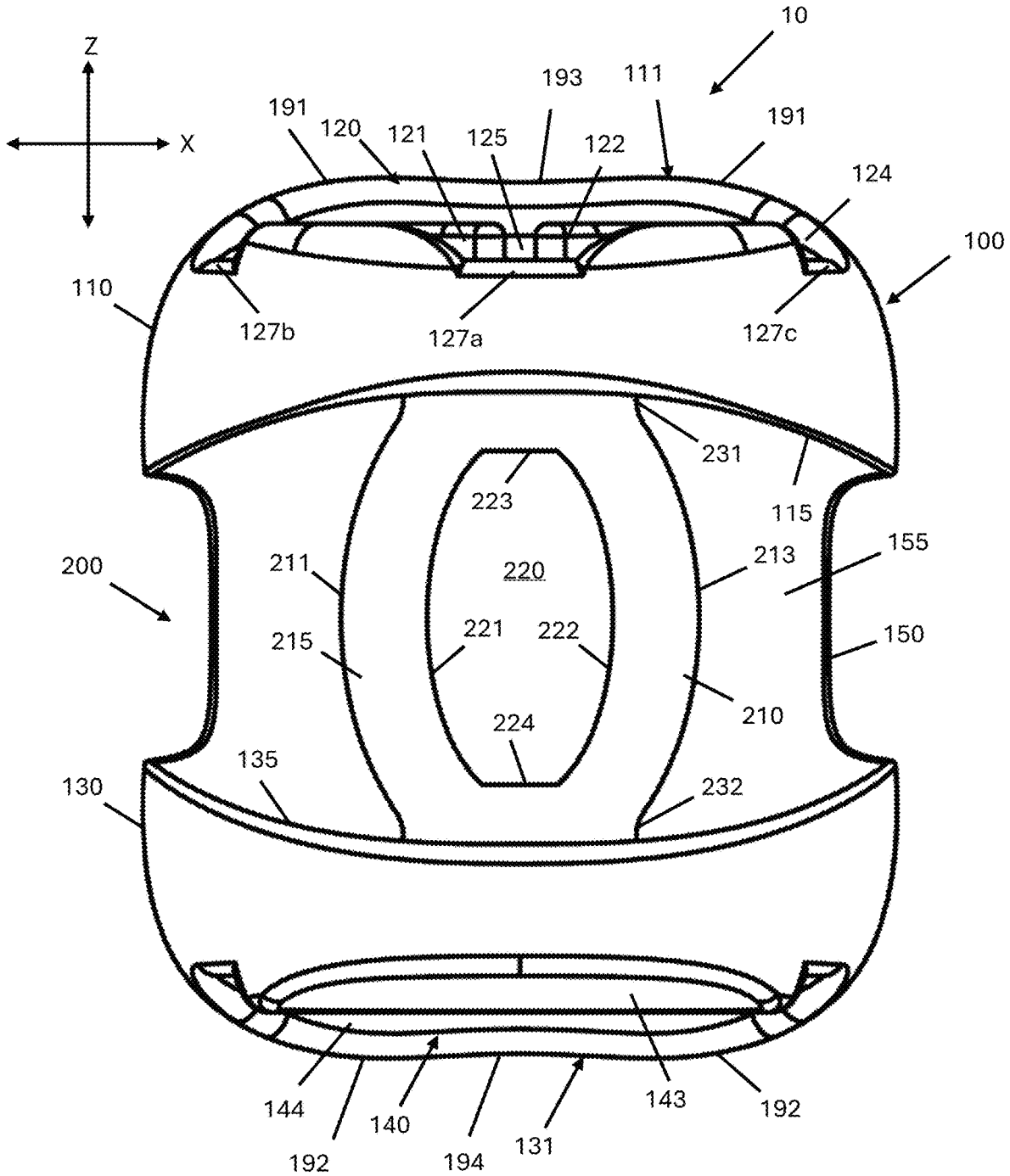
FIG. 4 shows a rear view of the mouth exercising device shown in FIG. 1.
Figure 5:
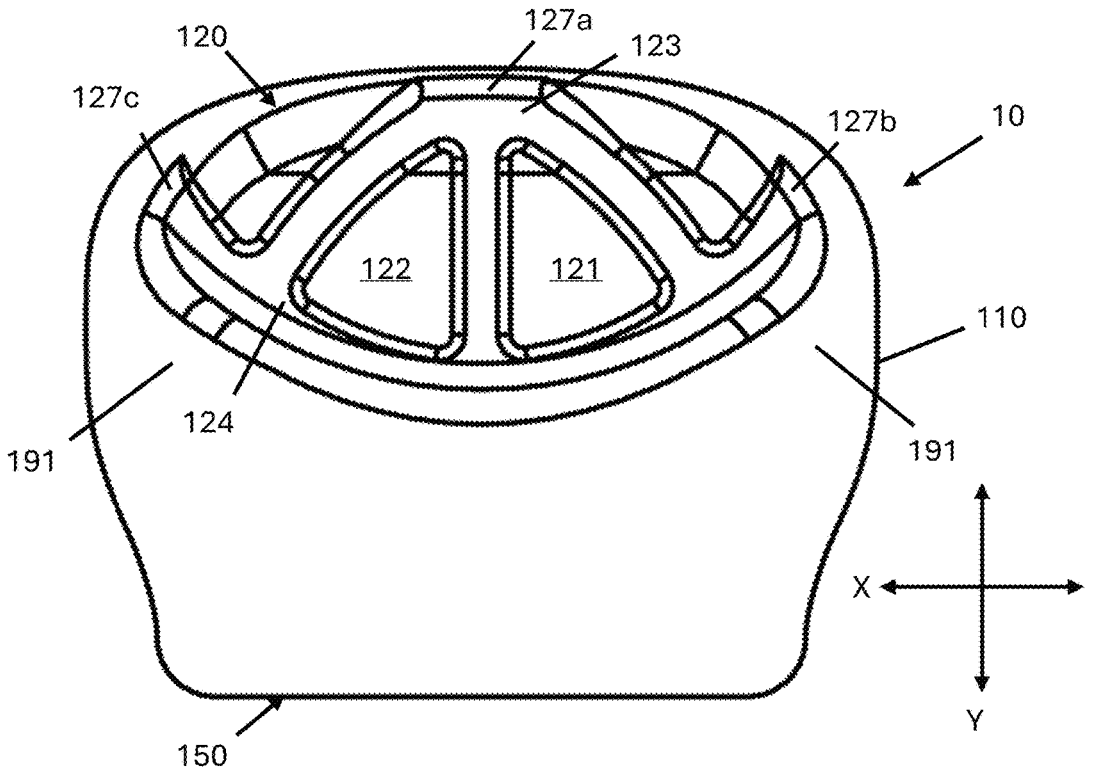
FIG. 5 shows a top view of the mouth exercising device shown in FIG. 1.
Figure 6:
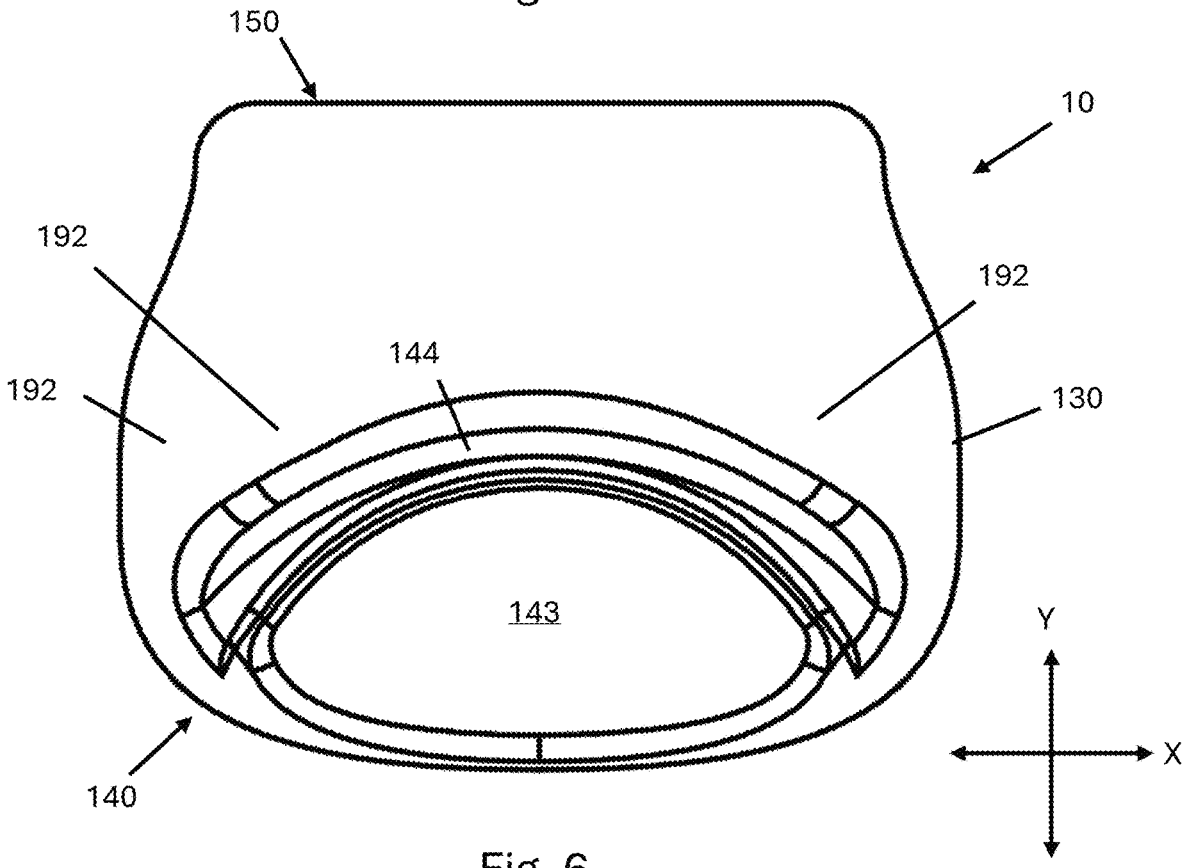
FIG. 6 shows a bottom view of the mouth exercising device shown in FIG. 1.

The upper body 110 may further include upper shoulder portions 191 near right and left ends of the upper surface 111. The upper shoulder portions 191 may extend farther in the upper direction than any other part of the upper body 110. As can be seen in FIG. 4, an upper central portion 193 between the upper shoulder portions 191 may be slightly concave so as to be lower than the upper shoulder portions 191. The upper shoulder portions 191 may be positioned directly in front of the upper positioning structure 120, and the upper shoulder portions 192 may be positioned directly in front of the lower positioning structure 140.

The lower body 130 may further include lower shoulder portions 192 near right and left ends of the lower surface 131. The lower shoulder portions 192 may extend farther in the lower direction than any other part of the lower body 130. As can be seen in FIG. 4, a lower central portion 194 between the lower shoulder portions 192 may be slightly concave so as to be higher than the lower shoulder portions 192.

The bridge portion 150 may extend between a front lower end of the upper body 110 and a front upper end of the lower body 130. The bridge portion 150 may extend farther forward than the upper body 110 and/or the lower body 130. The bridge portion 150 may have a convexly curved front surface and a concavely curved rear surface 155. The rear surface 155 may face the inner body 200 with a space 160 defined therebetween. The bridge portion 150 may be relatively thin along the Y-axis.

The inner body 200 may extend between the lower surface 115 of the upper body 110 and the upper surface 135 of the lower body 130. The inner body 200 may be an elastic structure. According to one or more embodiments, the inner body may have a constant thickness in the Y-axis, although the inner body 200 is not limited thereto.

The inner body 200 may include a main body 210, an upper connection structure 231 connecting the inner body 200 to the lower surface 115 of the upper body 110, and a lower connection structure 232 connecting the inner body 200 to the upper surface 135 of the upper body 130. As a non-limiting example, the main body 210 may be ring-shaped when viewed in the forward direction. The main body 210 may be an oval ring-shaped structure. The main body 210 may include a left outer surface 211, a right outer surface 213, a front surface 217, and a rear surface 215. The left outer surface 211 and/or the right outer surface 213 may be convexly curved. The front surface 217 and/or the rear surface 215 may be flat. The main body 210 may define a through-hole 220 extending along the Y-axis. As a non-limiting example, the through-hole 220 may be defined by a left inner surface 221, a right inner surface 222, an upper inner surface, 223, and a lower inner surface 224 of the main body 210. The curvature of the left outer surface 211 may correspond to the curvature of the left inner surface 221, and the curvature of the right outer surface 213 may correspond to the curvature of the right inner surface 222. The upper inner surface 223 and the lower inner surface 224 may be flat, although the upper inner surface 223 and/or the lower inner surface 224 may be curved.

As explained above, FIGS. 1-6 show the mouth exercising device 10 in a first configuration which may be an uncompressed state. The user may open his/her mouth and insert a rear side of the mouth exercising device 10 that is in the first configuration into the mouth such that the user's upper teeth engage with the upper positioning structure 120 and the user's lower teeth engage with the lower positioning structure 140. For example, the user's upper teeth may be positioned within the front recess 124 of the upper positioning structure 120 and the user's lower teeth may be positioned within the curved recess 144. The upper shoulder portion 191 may be the uppermost portion of the upper body 110 and the lower shoulder portion 192 may be the lowermost portion of the lower body 130. As such, the user's upper lips and/or an upper portion of the user's inner mouth engage with the upper shoulder portions 191, and the user's lower lips and/or a lower portion of the user's inner mouth engage with the lower shoulder portions 192. The user may close his/her mouth and use the muscles within and surrounding the mouth including, e.g., jaw and cheek muscles, to compress the mouth exercising device 10 along the Z-axis. As the user compresses the mouth exercising device 10 along the Z-axis, the upper positioning structure 120 and the lower positioning structure 140 may keep the mouth exercising device 10 from getting displaced along the X-axis and/or the Y-axis. As the upper positioning structure 120 includes recesses, e.g., the front recess 124 and the rear recess 123, during use of the mouth exercising device 10, the user's saliva may collect within the upper positioning structure 120. According to one or more embodiments, the first drain 127*a* may be positioned at a lowermost portion of the rear recess 123, and the second drain 127*b* and the third drain 127*c* may be positioned at lowermost portions of the front recess 124. As such, the saliva may flow out of the rear recess 123 via the first drain 127*a*, and the saliva may flow out of the front recess 124 via the second drain 127*b* and the third drain 127*c*. Thus, undesirable accumulation of saliva within the upper positioning structure 120 may be prevented. As the second drain 127*b* and the third drain 127*c* may be positioned at or near left and right ends of the front recess 124 along the X-axis, respectively, the channel 125 between the first plateau 121 and the second plateau 122 may allow flow of the saliva from a central portion of the front recess 124 towards the first drain 127*a*.

Figure 7:
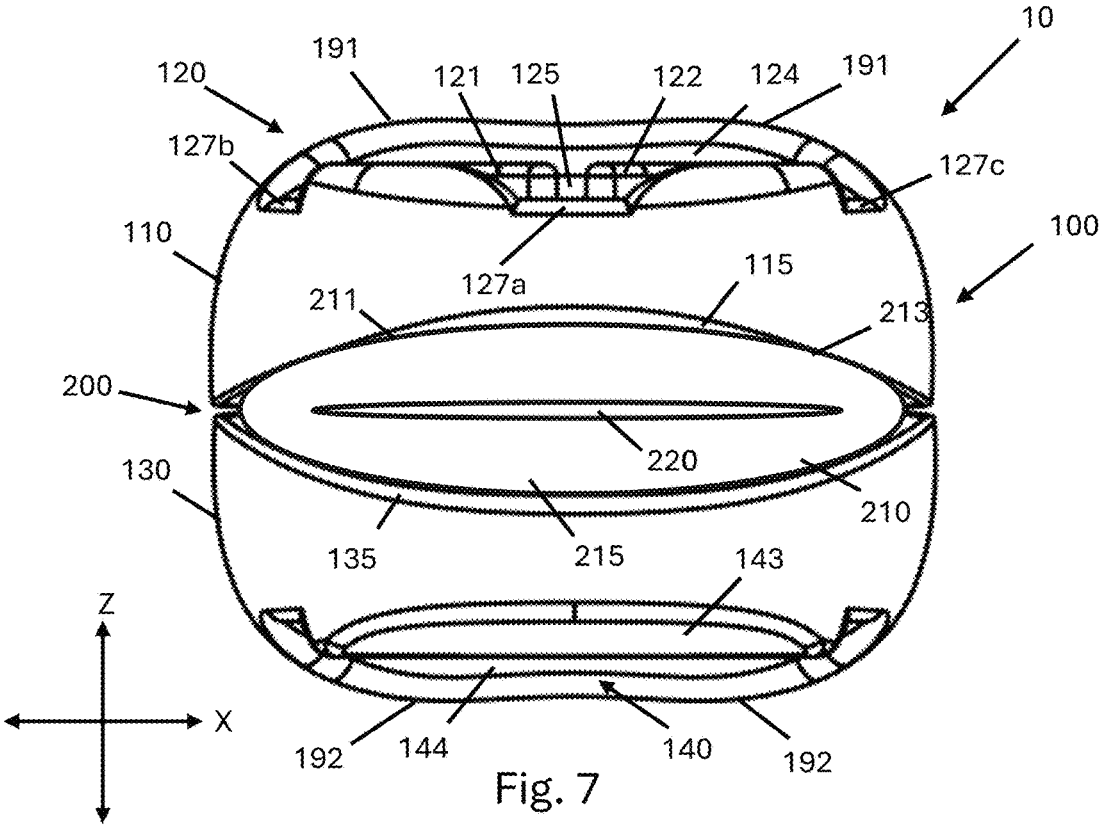
FIG. 7 shows a rear view of the mouth exercising device shown in FIG. 1 in a second configuration.

FIG. 7 shows the mouth exercising device 10 in a second configuration which may be a compressed state. For example, the user may compress the mouth exercising device 10 from the first configuration shown in FIGS. 1-6 to the second configuration shown in FIG. 7. The upper body 110 and the lower body 120 may be structured to have higher rigidity than the inner body 200. As such, while the upper body 110 and the lower body 120 may undergo some limited compression, most of the compression occurs within the inner body 200. As the bridge portion 150 is relatively thin along the Y-axis, the bridge portion 150 easily deforms and is pushed in the forward direction. As the inner body 200 is compressed, a left portion of the inner body 200 deforms leftward along the X-axis, and a right portion of the inner body 200 deforms rightward along the X-axis, although there may be some limited deformation of the inner body 200 along the Y-direction as well.

Thus, in the second configuration, upper portions of the left outer surface 211 and the right outer surface 213 may contact the lower surface 115 of the upper body 110, and lower portions of the left outer surface 211 and the right outer surface 213 may contact the upper surface 135 of the lower body 130. To facilitate such contact, the lower surface 115 of the upper body 110 may be shaped to correspond to the shapes and/or dimensions of the upper portions of the left outer surface 211 and the right outer surface 213 when compressed, and the upper surface 135 of the lower body 130 may be shaped to correspond to the shapes and/or dimensions of the lower portions of the left outer surface 211 and the right outer surface 213 when compressed. In the second configuration, left and right ends of the inner body 200 may be within left and right ends of the upper body 110 and/or the lower body 120. Additionally or alternatively, in the second configuration, upper portions of the left inner surface 221 and the right inner surface 222 may contact lower portions of the left inner surface 221 and the right inner surface 222. Additionally or alternatively, in the second configuration, the upper inner surface 223 may contact the lower inner surface 224. Additionally or alternatively, in the second configuration, the left ends of the upper body 110 and the lower body 130 may contact each other, and the right ends of the upper body 110 and the lower body 130 may contact each other. Once the mouth exercising device 10 has reached the second configuration, the user may release the compressive force thereon, and the elasticity of the mouth exercising device 10 may return the mouth exercising device 10 to the first configuration. The user may repeat compression and release of the mouth exercising device 10 to cycle the mouth exercising device 10 between the first and second configurations to exercise muscles within and around the user's mouth.

Figure 8:
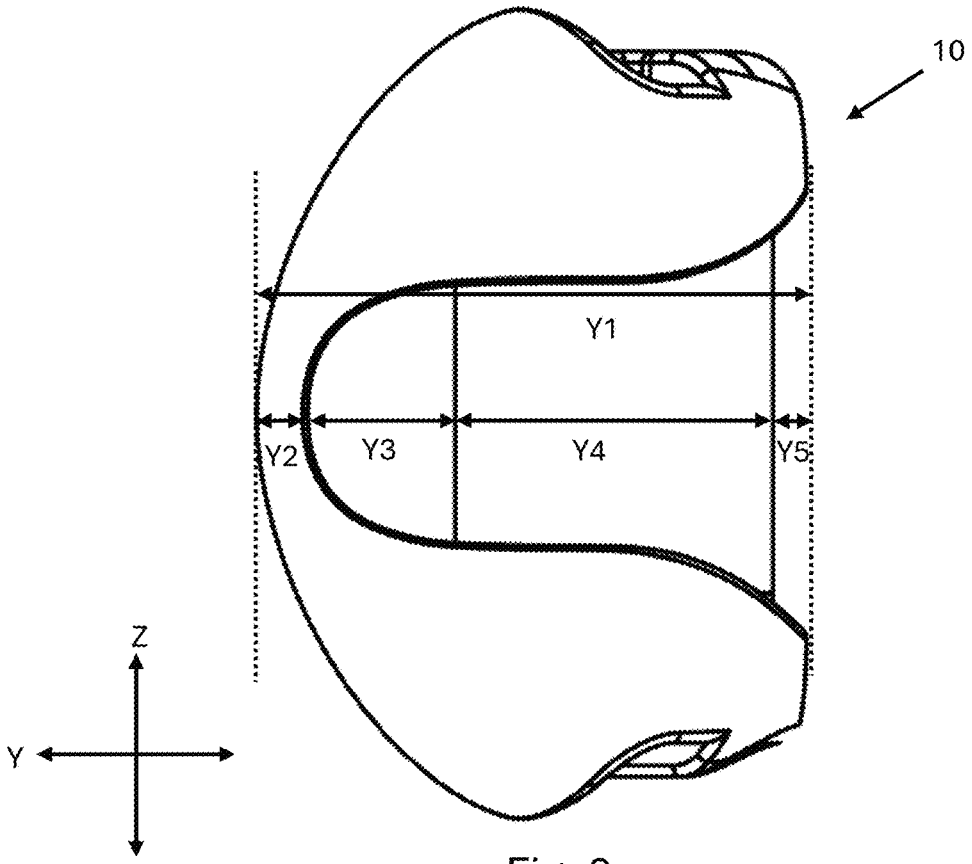
FIG. 8 shows a side view of the mouth exercising device shown in FIG. 1.
Figure 9:
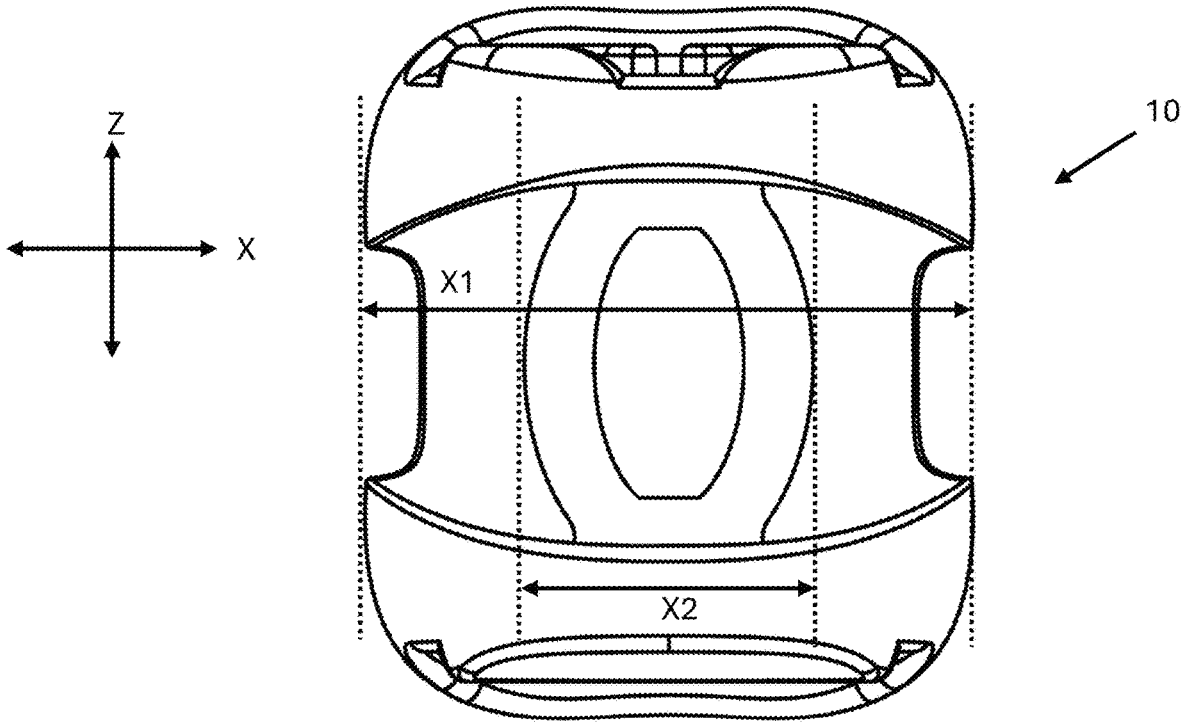
FIG. 9 shows a rear view of the mouth exercising device shown in FIG. 1 in a first configuration.
Figure 10:
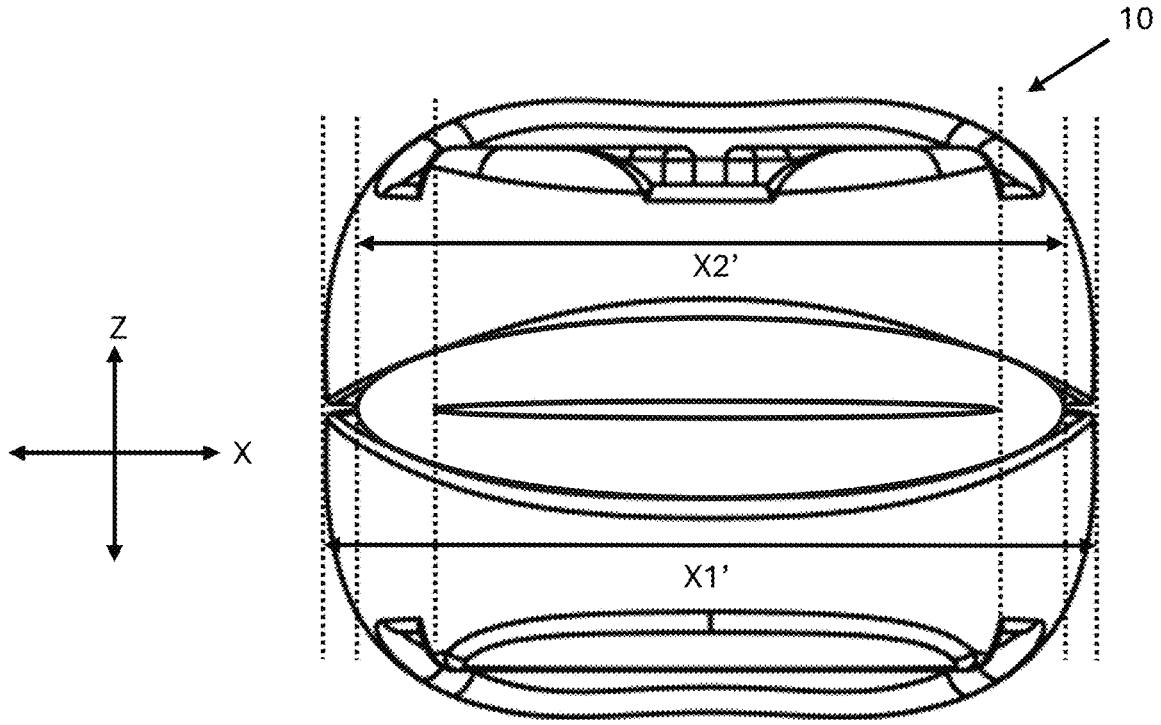
FIG. 10 shows a rear view of the mouth exercising device shown in FIG. 1 in a second configuration.

FIGS. 8 and 9 show side and rear views of the mouth exercising device in the first configuration, and FIG. 10 shows a rear view of the mouth exercising device in the second configuration.

As shown in FIG. 8, in the first configuration, the mouth exercising device 10 has a total length Y1 along the Y-axis, which includes a thickness Y2 of the bridge portion 150, a gap Y3 between the bridge portion 150 and the inner body 200, a length Y4 of the inner body 200 along the Y-axis, and a length Y5 that a rear end of the upper body 110 and/or the lower body 130 extends in the rearward direction beyond the inner body 200. According to one or more embodiments, the rear end of the upper body 110 and/or the lower body 130 may be flush with the inner body 200 such that Y5 is zero.

According to one or more embodiments, the length Y4 may be greater than the gap Y3, the gap Y3 may be greater than the thickness Y2, and the thickness Y2 may be greater than the length Y5. The thickness Y2 may be 5% to 15% of the total length Y1. The thickness Y2 may be 8% to 10% of total length Y1. The gap Y3 may be 20% to 30% of the total length Y1. The gap Y3 may be 25% to 27% of total length Y1. The length Y4 may be 50% to 60% of the total length Y1. The length Y4 may be 56% to 58% of total length Y1. The length Y5 may be 0% to 10% of total length Y1. The length Y5 may be 6% to 8% of total length Y1.

As shown in FIG. 9, in the first configuration, the mouth exercising device 10 has a total width X1 along the X-axis and the inner body 200 has a width X2 along the X-axis. According to one or more embodiments, the width X2 may be 40-50% of the total width X1. According to one or more embodiments, the width X2 may be 47-49% of the total width X1.

As shown in FIG. 10, in the second configuration, the mouth exercising device 10 has a total width X1' along the X-axis and the inner body 200 has a width X2' along the X-axis. According to one or more embodiments, the width X2' may be 85-100% of the total width X1'. According to one or more embodiments, the width X2' may be 90-95% of the total width X1'. According to one or more embodiments, the width X2' may be 90-92% of the total width X1'. According to one or more embodiments, the width X2 in the first configuration may be 35-50% of the width X2' in the second configuration. According to one or more embodiments, the width X2 in the first configuration may be 40-45% of the width X2' in the second configuration. According to one or more embodiments, the width X2 in the first configuration may be 41-43% of the width X2' in the second configuration.

Although an example is set forth above of cycling the mouth exercising device 10 between the first and second configurations, the user may instead cycle the mouth exercising device 10 between the first configuration and an intermediate configuration between the first and second configurations. That is, the mouth exercising device 10 may only be compressed to the intermediate configuration without reaching the second configuration and released to return from the intermediate configuration to the first configuration.

During use, the lips of the user may firmly grasp and wrap around the mouth exercising device 10. The user's top teeth may rest gently in the front recess 124 and the user's bottom teeth may rest gently in the curved recess 144. The user may then gently close the lips around the mouth exercising device 10 by bringing the lips together. The compression force on the mouth exercising device 10 may come from sides of the upper lip where the cheek muscles connect with the muscles surrounding the lips. As sides of the upper lip press down on the mouth exercising device, the user may lift the cheeks upward, which may generate a stretching and elongating motion. The user may then pulse the lips down on the mouth exercising device 10 while pulsing the cheeks up.

The user may maintain a light grip with the upper and lower teeth, allowing the jaw to open and close passively. The user may use the lips to open and close the mouth exercising device 10, while the upper and lower teeth maintain the position of the mouth exercising device 10 within the mouth. The user may maintain a light but firm grip on the mouth exercising device with the upper and lower teeth to exercise facial muscles. As explained above, rather than compressing the mouth exercising device 10 to the second configuration, the user may only compress the mouth exercising device 10 a small amount, e.g., an inch or less, to the intermediate configuration during the exercise.

According to one or more embodiments, the mouth exercising device 10 may provide a non-invasive, easy-to-use device that effectively lifts and builds cheek muscle, creating natural volume in the cheekbone area. Use of the mouth exercising device 10 may reduce fine lines in the face, plump lips, and/or sculpt the face and neck. The mouth exercising device 10 may tighten, lift, and/or tone loose skin around the mouth and jaw, targeting areas such as jowls and nasolabial folds.

The terms "a" and "an" do not denote a limitation of quantity, but rather denote the presence of at least one of the referenced items. The term "or" means "and/or" unless clearly indicated otherwise by context. Reference throughout the specification to "an aspect", means that a particular element (e.g., feature, structure, step, or characteristic) described in connection with the aspect is included in at least one aspect described herein, and may or may not be present in other aspects. In addition, it is to be understood that the described elements may be combined in any suitable manner in the various aspects.

When an element such as a layer, film, region, or substrate is referred to as being "on" another element, it can be directly on the other element or intervening elements may also be present. In contrast, when an element is referred to as being "directly on" another element, there are no intervening elements present.

Unless specified to the contrary herein, all test standards are the most recent standard in effect as of the filing date of this application, or, if priority is claimed, the filing date of the earliest priority application in which the test standard appears.

Unless defined otherwise, technical, and scientific terms used herein have the same meaning as is commonly understood by one of skill in the art to which this disclosure belongs.

While the above disclosure has been described with reference to exemplary embodiments, it will be understood by those skilled in the art that various changes may be made and equivalents may be substituted for elements thereof without departing from its scope. In addition, many modifications may be made to adapt a particular situation or material to the teachings of the disclosure without departing from the essential scope thereof. Therefore, it is intended that the present disclosure not be limited to the particular embodiments disclosed, but will include all embodiments falling within the scope thereof.

What is claimed is:

1. A mouth exercising device defining a first direction and a second direction along a first axis, a third direction and a fourth direction along a second axis orthogonal to the first axis, and a fifth direction and a sixth direction along a third axis orthogonal to the first axis and the second axis, the mouth exercising device comprising:

an outer body comprising a first body and a second body arranged along the second axis; and an inner body extending between a first surface of the first body that faces the fourth direction and a first surface of the second body that faces the third direction, wherein the mouth exercising device has a first configuration that is an uncompressed state and a second configuration that is a compressed state, wherein, in the first configuration, a first outer surface of the inner body in the fifth direction and a second outer surface of the inner body in the sixth direction do not contact the first surface of the first body or the first surface of the second body, and wherein, in the second configuration, at least a portion of the first outer surface of the inner body contacts the first surface of the first body and the first surface of the second body, and at least a portion of the second outer surface of the inner body contacts the first surface of the first body and the first surface of the second body.

2. The mouth exercising device of claim 1, wherein the outer body comprises a bridge portion extending between the first body and the second body along the second axis.

3. The mouth exercising device of claim 2, wherein the outer body comprises a bridge portion extending between the first body and the second body along the second axis, and wherein a gap is formed between the bridge portion and the inner body.

4. The mouth exercising device of claim 1, wherein the outer body is formed of a material having a first modulus of elasticity, the inner body is formed of a material having a second modulus of elasticity, and the second modulus of elasticity is lower than the first modulus of elasticity.

5. The mouth exercising device of claim 1, wherein the inner body and the outer body are formed of food-grade silicone.

6. The mouth exercising device of claim 1, wherein the first body comprises a first positioning structure on a second surface of the first body that faces the third direction.

7. The mouth exercising device of claim 6, wherein the first positioning structure comprises a first recess that is curved.

8. The mouth exercising device of claim 7, wherein a drain is formed at an end of the first recess in the fifth or sixth direction.

9. The mouth exercising device of claim 7, wherein the upper positioning structure comprises a second recess disposed in the second direction of the first recess.

10. The mouth exercising device of claim 9, wherein a drain is formed an end of the second recess in the second direction.

11. The mouth exercising device of claim 1, wherein the second body comprises a second positioning structure on a second surface thereof that faces the fourth direction.

12. The mouth exercising device of claim 11, wherein the second positioning structure comprises a curved recess.

13. The mouth exercising device of claim 1, wherein the inner body comprises a ring-shaped structure having a through-hole formed therein.

14. The mouth exercising device of claim 1, wherein the first body comprises a pair of first shoulder portions that extend farther in the third direction than a remainder of the first body.

15. The mouth exercising device of claim 14, wherein the first body comprises a first central portion extending continuously between the first shoulder portions, the first shoulder portions extending farther in the third direction than the central portion.

16. The mouth exercising device of claim 1, wherein the second body comprises a pair of second shoulder portions that extend farther in the fourth direction than a remainder of the second body.

17. The mouth exercising device of claim 1, wherein the second body comprises a second central portion extending continuously between the second shoulder portions, the second shoulder portions extending farther in the fourth direction than the central portion.

18. The mouth exercising device of claim 1, wherein the inner body has a length along the first axis that is 50% to 60% of a total length of the mouth exercising device along the first axis.

19. The mouth exercising device of claim 1, wherein the inner body and the outer body are integrally formed.

* * * * *